United States Patent [19]

Blasucci

[11] 4,149,156

[45] Apr. 10, 1979

[54] WINDOW ALARM EMPLOYING A RELEASABLY MOUNTED PLUNGER SWITCH

[76] Inventor: Leonard Blasucci, 98 Roosevelt Ave., Jersey City, N.J. 07304

[21] Appl. No.: 805,508

[22] Filed: Jun. 10, 1977

[51] Int. Cl.[2] ..... G08B 13/08

[52] U.S. Cl. ..... 340/545; 200/61.93; 340/546

[58] Field of Search ..... 340/274 R, 545, 546; 200/61.73, 61.72, 61.71, 61.93

[56] References Cited

U.S. PATENT DOCUMENTS

| | | | |
|---|---|---|---|
| 3,175,207 | 3/1965 | Hewitt, Jr. | 390/274 R |
| 3,409,886 | 11/1968 | Davis et al. | 340/274 R |
| 3,594,763 | 7/1971 | Peek | 340/274 R |
| 3,641,540 | 2/1972 | Cutler et al. | 340/274 R |
| 3,797,005 | 3/1974 | Schwarz | 340/274 R |
| 4,023,156 | 5/1977 | Galvin | 340/274 R |

*Primary Examiner*—Glen R. Swann, III

*Attorney, Agent, or Firm*—Blum, Moscovitz, Friedman & Kaplan

[57] ABSTRACT

A plunger switch is releasably held against the inner surface of the outer section of a double-hung window or sliding door; by a suction cup, in an exemplary embodiment. Movement of the inner section with respect to the outer section dislodges the suction cup, releasing the switch and allowing it to close. Closure of the switch actuates a signalling means to generate an alarm signal.

16 Claims, 8 Drawing Figures

FIG. 1A
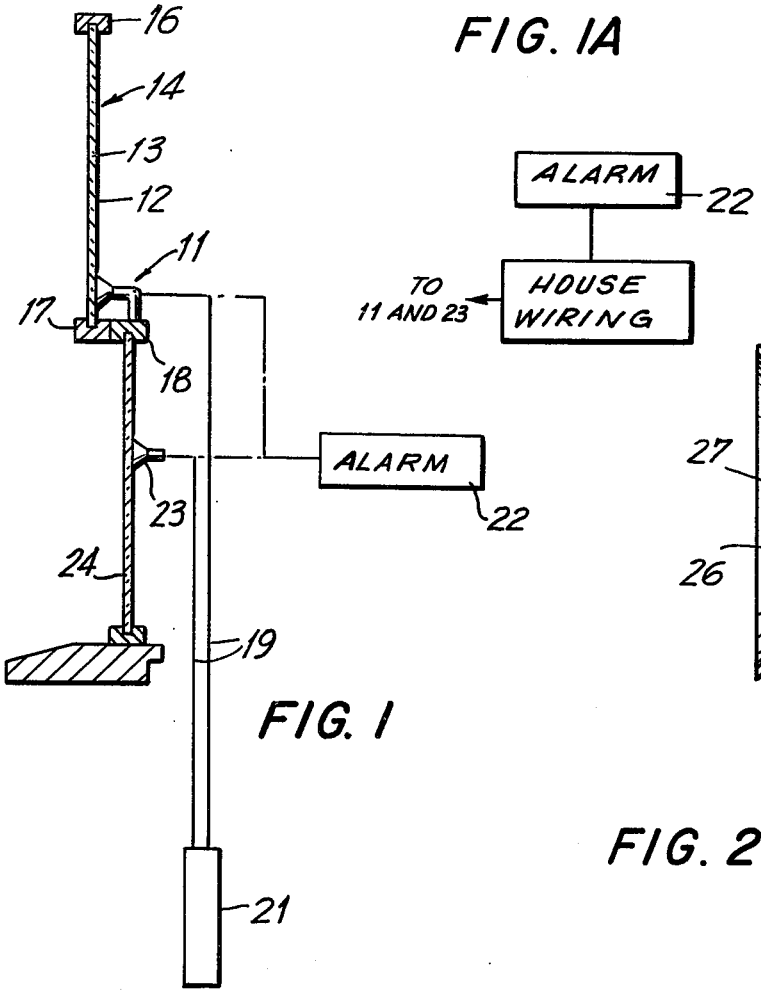
FIG. 1
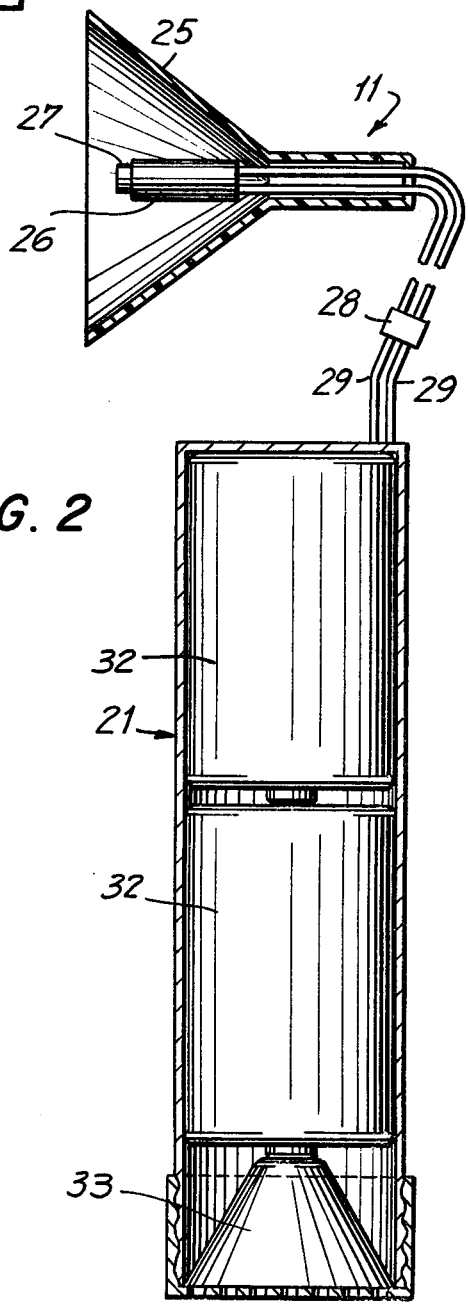
FIG. 2
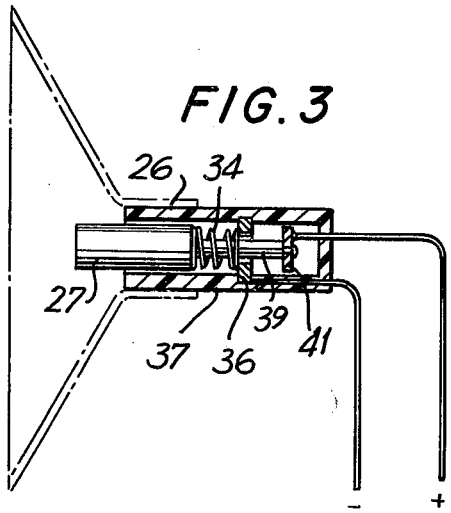
FIG. 3

WINDOW ALARM EMPLOYING A RELEASABLY MOUNTED PLUNGER SWITCH

BACKGROUND OF THE INVENTION

With the surge in the crime rate in general and, particularly in the burglary rate, there has been a proliferation of protective devices, directed mostly toward prevention of illegal entry through doors. Bars and gratings of various types have been placed across windows but, in addition to being unsightly, these constitute a serious danger in that they may prevent rapid escape in the event of fire. Moreover, the cost of such devices, when added to installation costs, makes complete protection of all windows in an apartment or home almost prohibitively expensive. Somewhat the same problem arises with respect to sliding doors whether of the type where a single door slides into a wall or the double type where either of a pair of sliding doors can be moved past the other.

While complete prevention of illegal entry by intruders provides the ultimate in protection, nevertheless, an effective alarm system, which is sufficiently inexpensive so that it can be widely applied, can provide a measure of protection which substantially increases the security of the inhabitants. As is evident, then, an inexpensive but effective device, which is reliable and readily installed, is desired.

SUMMARY OF THE INVENTION

In a double-hung window, each window sash slides in its own track, usually vertical, and one window-sash, with its corresponding pane of glass is external to the other. The construction is usually such that when the window is completely closed, the lower edge of the upper window-sash, which is usually the outer window, is flush with the upper edge of the lower window-sash. According to the present invention, a sensor, which includes readily-releaseable attachment means, is attached to the inner surface of the upper window proximate the lower portion of the corresponding window-sash. The sensor projects away from the inner surface of the window so that movement of either of the window-sashes to an extent greater than a pre-selected amount, where the pre-selected amount may be zero, dislodges the sensor from its point of attachment. The sensor is so constructed that such a dislodgement causes the generation of an alarm signal by a buzzer, the lighting of an indicator light or a radio tranmission to a centrally-located receiver.

A preferred means of initiating the alarm is a plunger switch that is deactivated by pressing the plunger against the window in the act of attachment. A preferred means of attachment is by means of a suction cup constituting part of the housing holding the plunger. The alarm generation means can be powered by internal cells, by an external power pack or by connection to house current.

Accordingly, it is an object of the instant invention to provide an improved window alarm device.

A further object of the instant invention is to provide an improved alarm device that is particularly suited for use with double hung windows or sliding doors having at least two sections.

Still a further object of the instant invention is to provide an inexpensive, portable and reliable window and sliding door alarm device.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is a section through a double-hung window showing devices in accordance with the present invention in operating position and means for powering same;

FIG. 1A is an alternate embodiment of the device depicted in FIG. 1;

FIG. 2 is a sectional view of a device in accordance with the present invention including a sensor, a power pack and an alarm buzzer;

FIG. 3 is a sectional view of an embodiment of the instant invention sgowing the internal circuitry thereof;

DETAILED DESCRIPTION OF THE PREFERRED EMBODIMENTS

Figure 4:
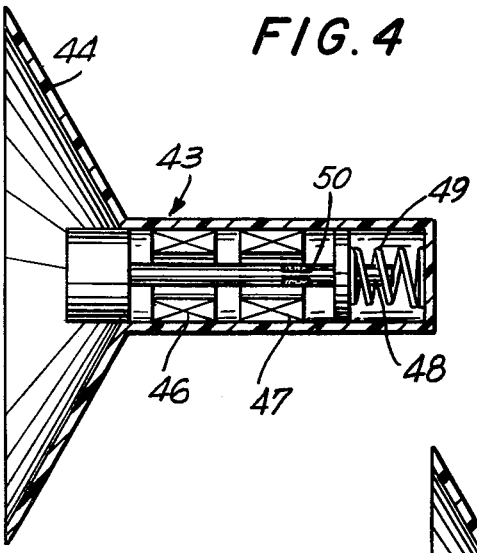
FIGS. 4 and 5 are further embodiments of the invention.

Reference is now made to FIG. 1 wherein a schematic, illustrating how devices of the present invention can be used to produce an alarm signal when a window, fitted for such a device or devices, is opened by an intruder, is provided. The sensor indicated generally by the reference numeral 11 is attached to inner surface 12 of window pane 13 in the upper section of the double-hung window, said upper section being indicated generally by the reference numeral 14.

Window-pane 13 is in window-sash 16. Sensor 11 is preferably placed proximate lower edge 17 of upper window-sash 16. Optionally, sensor 11 may be shaped so that when placed in the position specified, any motion of lower sash 18, in an upward direction, or of upper sash 16, in a downward direction, will dislodge sensor 11 which is releaseably attached to window-pane 13. Optionally, of course, sensor 11 may be placed far enough away from lower edge 17 of window-sash 16 so that the window may be kept partially opened so as to permit ventilation, but yet not so far open as to permit entry of an intruder.

The sensor 11 may be connected through wires 19 to an alarm-signalling pack 21 which may be internally-powered by electrochemical cells. Alternatively, as illustrated in FIG. 1A the sensor may be powered by house wiring which also powers an alarm 22.

In order to prevent entry by breakage of a glass window, a sensor 23 is desirably placed on the interior surface of window-pane 24 in the lower window-sash 18. Breakage of either the lower window 24 or the upper window 13 will dislodge the corresponding sensor and activate an appropriately-disposed alarm means.

As is illustrated in FIGS. 2 and 3, a preferred means of attaching a sensor to a window-pane is by use of a suction cup 25 which may be of rubber and may constitute an integral part of the sensor. A plunger switch 26 includes a button 27 at the end thereof which is pushed inwardly when the sensor is pushed against a surface to attach said sensor releaseably to said surface. Pushing button 27 inwardly opens the switch so that the alarm-means is not activated. Preferably, an external switch 28 is provided for preventing activation of alarm-means when the sensor is not in use.

As shown in FIG. 2, the sensor may be connected by wires 29 to a power pack, indicated generally by the reference numeral 31, which power pack contains electrochemical cells 32. Also, the power pack may contain an alarm-means, in this case, an electric buzzer 33. Plunger switch 26 is illustrated in detail in FIG. 3. Push button 27 is biased outwardly by spring 34. A contact 36 is integral with housing 37 of the embodiment of FIG. 3. Shaft 39, carrying electrical contact 41, is integral with plunger 27. When the sensor of FIG. 3 is dislodged from a surface, spring 34 forces push button 27 outwardly until contact is made between ring contact 36 and disc 41, thereby establishing electrical continuity through the power source and activating the alarm means. It is noted that the plunger switch, power source and alarm means can be constructed and arranged so that electrical continuity is established between the plunger switch and the power source when the push button 27 is depressed and, further, so that electrical continuity is effected between the power source and alarm means when the push button 27 is forced outwardly by dislodgement of the suction cup from a surface.

A second embodiment of the sensor of the present invention, generally indicated as 43, is shown in FIG. 4 where sensor 43 can be attached to a surface by means of a suction cup 44 or by means of a weak adhesive. In the embodiment of FIG. 4 the power pack is in the form of annular electrochemical cells 46 which are contained within the sensor. The alarm means consists of a radio transmitter 47 for transmitting a signal to an appropriately located receiver (not shown). Again, a plunger switch 48, under the biasing action of a spring 49, is responsible for establishing electrical contact between contacts 50 and transmitter 47 (circuitry not shown) to transmit an alarm signal when the sensor 43 is dislodged.

Figure 5:
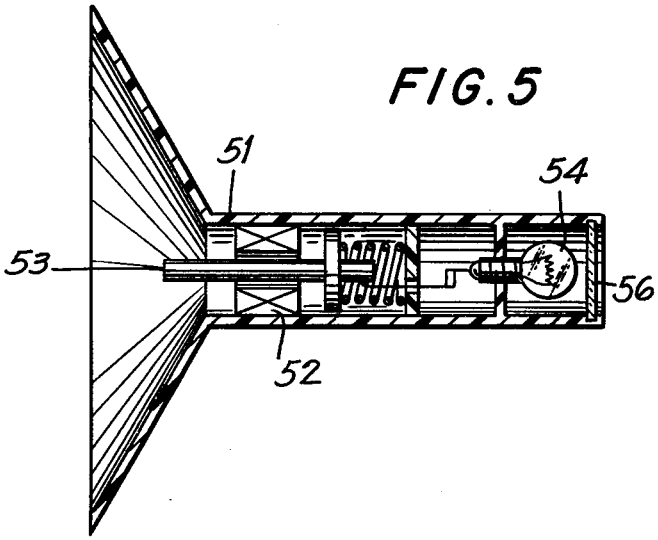

A further embodiment of the sensor of the present invention, generally indicated as 51 is illustrated in FIG. 5, wherein electrochemical cells 52 are activated by a plunger switch 53 to turn on a light 54 covered by a lens 56. Such a light and lens arrangement can be used with the power pack 31 of FIG. 2 instead of the buzzer 33 shown therein.

Figure 6:
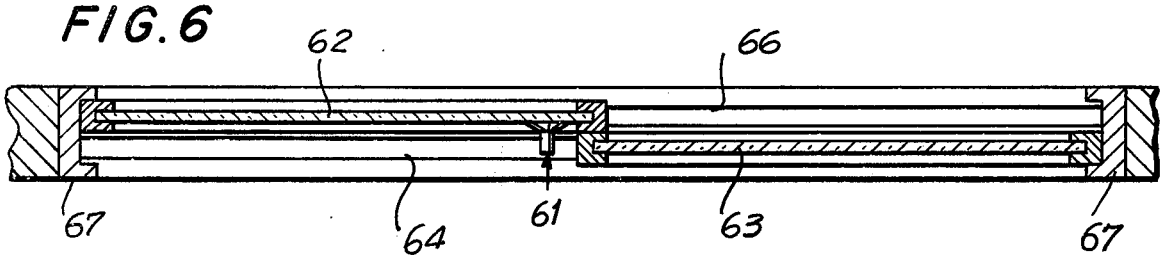
FIGS. 6 and 7 show schematically how the device of subject invention can be used with sliding doors.

FIG. 6 illustates the manner in which the sensors of the present invention, indicated by the reference numeral 61, can be used in combination with sliding doors. in FIG. 6, two sliding doors 62 and 63 are depicted as riding on guide rails 64 and 66, respectively. In a closed position, doors 62 and 63 make contact with door frame 67. In FIG. 6, as shown, door 62 is exterior and door 63 is interior, each door having exterior and interior surfaces. Sensor 61 is attached to the inner surface of exterior door 62 so that movement of either door, away from door frame 67, will cause dislodgement of sensor 61 and activation of an alarm-means (not shown).

Figure 7:
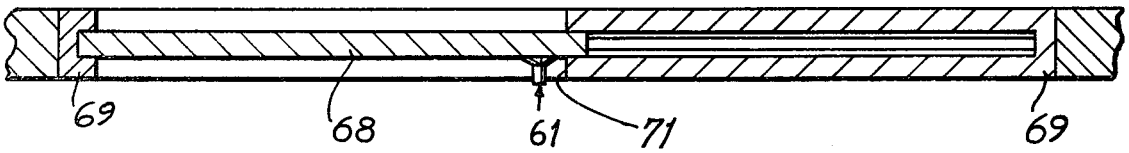

FIG. 7 shows the use of sensor 61 in combination with a single sliding door 68 which, in open position, slides into door frame 69. In this case, sensor 61 is dislodged by making contact with end 71 of door frame 69.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention which, as a matter of language, might be said to fall therebetween.

What is claimed is:

1. A device for signalling the unwanted opening of either section of a closure means in two sections, at least one section of which is mounted for sliding past the other section, said closure means having an inner-section and an outer-section, and each section having an inner face with respect to an enclosure, said device comprising a sensor including means for releasably attaching same to the inner face of said outer-section proximate said inner-section so that movement of one section relative to the other in the direction for opening said closure means will dislodge said sensor, and signalling means operatively associated with said sensor for indicating the dislodgement of said sensor.

2. The devcie as defined in claim 1, wherein said means for releaseably attaching said sensor is a suction cup.

3. The device as defined in claim 1, wherein said signalling means includes a plunger switch so constructed and arranged as to be in non-signalling disposition when said sensor is attached to said section and in signalling disposition when said sensor is dislodged from said section.

4. The device as defined in claim 1, wherein said signalling means is a radio-transmitter.

5. The device as defined in claim 1, wherein said signalling means is a light.

6. The device as defined in claim 1, wherein said signalling means includes a source of an audible sound.

7. The device as defined in claim 1, wherein said signalling means includes at least one electrochemical cell for powering same.

8. The device as defined in claim 7, wherein said electrochemical cell is internal to said sensor.

9. The device as defined in claim 1, wherein said electrochemical cell is external to said sensor and said device further comprises electrical connections between said signalling means and said electrochemical cell.

10. The device as defined in claim 1, wherein said device is arranged and constructed for powering by house current.

11. The device as defined in claim 1, wherein at least a poertion of said inner section is of glass, and further comprising a second sensor including means for releaseably attaching same to the inner face of said glass portion of said inner section so that breakage of said glass portion will dislodge said second sensor, said signalling means being operatively associated with said second sensor for indicating the dislodgement of said second sensor.

12. The device as defined in claim 11, further comprising a single electrochemical power source for activation of said signalling means.

13. The device as defined in claim 1, wherein said releasable attaching means is a readily breakable adhesive.

14. The device as defined in claim 1, wherein said inner section of said door is a wall into which said outer section can be displaced for opening said door.

15. An alarm device comprising in combination a sensor, said sensor including a plunger switch means adapted to produce an energizing signal when same is in a non-depressed position and a suction cup supporting said plunger switch means, said suction cup being adapted to be releasably secured to a substantially flat surface to thereby dispose the plunger switch means in a depressed position and prevent an energizing signal from bein produced thereby, and signalling means coupled to said plunger switch means for producing an alarm signal in response to said energizing signal being applied thereto.

16. An alarm device as claimed in claim 15, wherein said plunger switch means includes a resilient biasing means for normally biasing said plunger switch means in a non-depressed position when the suction cup is dislodged from a substantially flat surface.

* * * * *